US010571826B2

(12) United States Patent
Tanimoto et al.

(10) Patent No.: US 10,571,826 B2
(45) Date of Patent: Feb. 25, 2020

(54) DEVELOPER SUPPLYING DEVICE AND IMAGE FORMING APPARATUS

(71) Applicant: Konica Minolta, Inc., Chiyoda-ku, Tokyo (JP)

(72) Inventors: Hiroshi Tanimoto, Toyokawa (JP); Yasuaki Tomoda, Toyohashi (JP); Youichi Itagaki, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/046,269

(22) Filed: Jul. 26, 2018

(65) Prior Publication Data

US 2019/0064701 A1 Feb. 28, 2019

(30) Foreign Application Priority Data

Aug. 29, 2017 (JP) ..... 2017-163880

(51) Int. Cl.
*G03G 15/08* (2006.01)

(52) U.S. Cl.
CPC ..... *G03G 15/0889* (2013.01); *G03G 15/0865* (2013.01)

(58) Field of Classification Search
USPC ..... 399/254, 120
See application file for complete search history.

(56) References Cited

U.S. PATENT DOCUMENTS

2007/0048024 A1* 3/2007 Choi ..... G03G 15/0822 399/254
2008/0260441 A1* 10/2008 Takagi ..... G03G 21/12 399/360
2017/0031269 A1* 2/2017 Hatanaka ..... G03G 15/0858

FOREIGN PATENT DOCUMENTS

JP 03221980 A * 9/1991
JP H11015272 A 1/1999
JP 2001092226 A * 4/2001 ..... G03G 15/0875
JP 2002-236410 A 8/2002
JP 2016-206651 A 12/2016

* cited by examiner

*Primary Examiner* — Quana Grainger
(74) *Attorney, Agent, or Firm* — Squire Patton Boggs (US) LLP

(57) ABSTRACT

A developer supplying device for supplying a developer to a subject to be supplied includes: a housing; and a stirring member rotatable around a rotational axis in the housing, wherein the stirring member includes: a main body that includes a flexible sheet, extends away from the rotational axis, and is in contact with an inner wall surface of the housing; and a cut part formed in the main body, and the cut part projects from the main body when the main body is bent along with rotation of the stirring member.

15 Claims, 19 Drawing Sheets

DEVELOPER SUPPLYING DEVICE AND IMAGE FORMING APPARATUS

The entire disclosure of Japanese patent Application No. 2017-163880, filed on Aug. 29, 2017, is incorporated herein by reference in its entirety.

BACKGROUND

Technological Field

The present invention relates to developer supplying devices and image forming apparatuses. In particular, the invention relates to a developer supplying device and an image forming apparatus capable of smoothly supplying a developer to a subject to be supplied.

Description of the Related Art

Electrophotographic image forming apparatuses include multi-function peripherals (MFPs), facsimile apparatuses, copying apparatuses, and printers. MFPs have a scanner function, a facsimile function, a copying function, a printer function, a data communication function, and a server function.

This type of image forming apparatus forms a toner image by developing, with a developing device, an electrostatic latent image formed on an image carrier, transfers the toner image to a recording medium, and fixes the toner image on a sheet of paper with a fixing device. An image is thus formed on the recording medium. When toner is reduced in the developing device, toner is supplied through a toner container, which is referred to as a toner cartridge, to the developing device. The toner container is removable from an image forming apparatus body. When the toner container mounted in the image forming apparatus is emptied, someone such as a person in charge exchanges the emptied old toner container for a new toner container which is filled with toner.

A toner container generally includes a housing, a stirring member, and a transporting member. The stirring member is made of a flexible film and provided in the housing. The stirring member serves to, while stirring toner in the housing by rotation, send the toner to the transporting member. The transporting member serves to transport the toner in the housing to a discharge port connected to a supply port of a developing device. The stirring member also serves to scrape toner deposited on an inner wall of the housing by rotation and crush agglomerated toner.

For example, JP H11-15272 A, JP 2002-236410 A, and JP 2016-206651 A disclose configurations of conventional toner containers. JP H11-15272 A discloses a toner feeding device including a transporting member that includes a shaft and a blade. The blade is provided on the shaft such that a phase is continuously changed in an axial direction of the shaft. Rotation of the shaft transports powder toner to a powder toner feeding port.

JP 2002-236410 A discloses a stirring member that is made of a flexible member and rotatably provided in a toner feeding container. The stirring member, while stirring toner held in the toner feeding container, transports the toner to a toner feeding port. In the stirring member, a plurality of slits extending in a direction orthogonal to a rotational axis is formed with tips thereof tilted to the central side in a rotational axis direction. A hole is formed in at least one of regions separated by the slits.

JP 2016-206651 A discloses a transporting unit including a rotational shaft member and a sheet member. The transporting unit is placed rotatably in a developer storing container and feeds a developer in a radial direction while stirring the developer in a rotational axis direction by rotation. The transporting unit includes a reinforcing unit, as a reinforcing system for adjusting bending of the sheet member. The reinforcing unit has a plurality of parts different in strength, and the parts include a part for adjusting stirring capability of a developer in a rotational axis direction and a part for adjusting transportability of the developer in a radial direction.

In recent years, melting points of toner has been increasingly lowered to achieve fixation at low temperatures in terms of energy saving. Unfortunately, with lowering of melting points of toner, a problem arises in that in developer supplying devices, developers tightly deposit on an inner wall surface of a housing and the developers cannot be supplied to a subject to be supplied.

By way of example, the developer supplying device is assumed to be a toner container. When the toner container is stored for a long time under a poor environment such as hot and humid condition, toner in a housing may flocculate and tightly deposit on an inner wall surface of the housing. This may disable removal (scraping) of the toner even with a stirring member. If toner is left deposited on an inner wall of the housing, the toner cannot be supplied to a developing device despite the fact that the toner remains in the toner container. The toner container then may need to be exchanged for a new one. As a result, a portion of the toner in the toner container may be abandoned without being used, and an owner of an image forming apparatus may suffer an economic loss.

The problem that a developer cannot be supplied to a subject to be supplied due to the developer tightly depositing on an inner wall surface of a housing may arise not only in toner containers but in developer supplying devices in general for supplying developers, such as a toner reservoir referred to as a hopper. The toner reservoir transports toner from a toner container to a developing device.

To solve the above problems, an object of the invention is to provide a developer supplying device and an image forming apparatus capable of smoothly supplying a developer to a subject to be supplied.

SUMMARY

The present invention has been made to solve the problems described above, and an object thereof is to provide a developer supplying device and an image forming apparatus capable of smoothly supplying a developer to a subject to be supplied.

To achieve the abovementioned object, according to an aspect of the present invention, a developer supplying device for supplying a developer to a subject to be supplied reflecting one aspect of the present invention comprises: a housing; and a stirring member rotatable around a rotational axis in the housing, wherein the stirring member includes: a main body that includes a flexible sheet, extends away from the rotational axis, and is in contact with an inner wall surface of the housing; and a cut part formed in the main body, and the cut part projects from the main body when the main body is bent along with rotation of the stirring member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

In the following embodiment, a case in which an image forming apparatus is an MFP will be described. A developer supplying device is mounted in the image forming apparatus. Besides an MFP, the image forming apparatus in which a developer supplying device is mounted may be, for example, a facsimile apparatus, a copying apparatus, or a printer.

Note that, in the figures, seen from the front, a width direction of an image forming apparatus 1 is referred to as the x-axis direction, a depth direction as the y-axis direction, and a height direction as the z-axis direction. Each of the x-axis, y-axis, and z-axis is orthogonal to each other.

Firstly, the configuration of an image forming apparatus in the present embodiment will be described.

Figure 1:
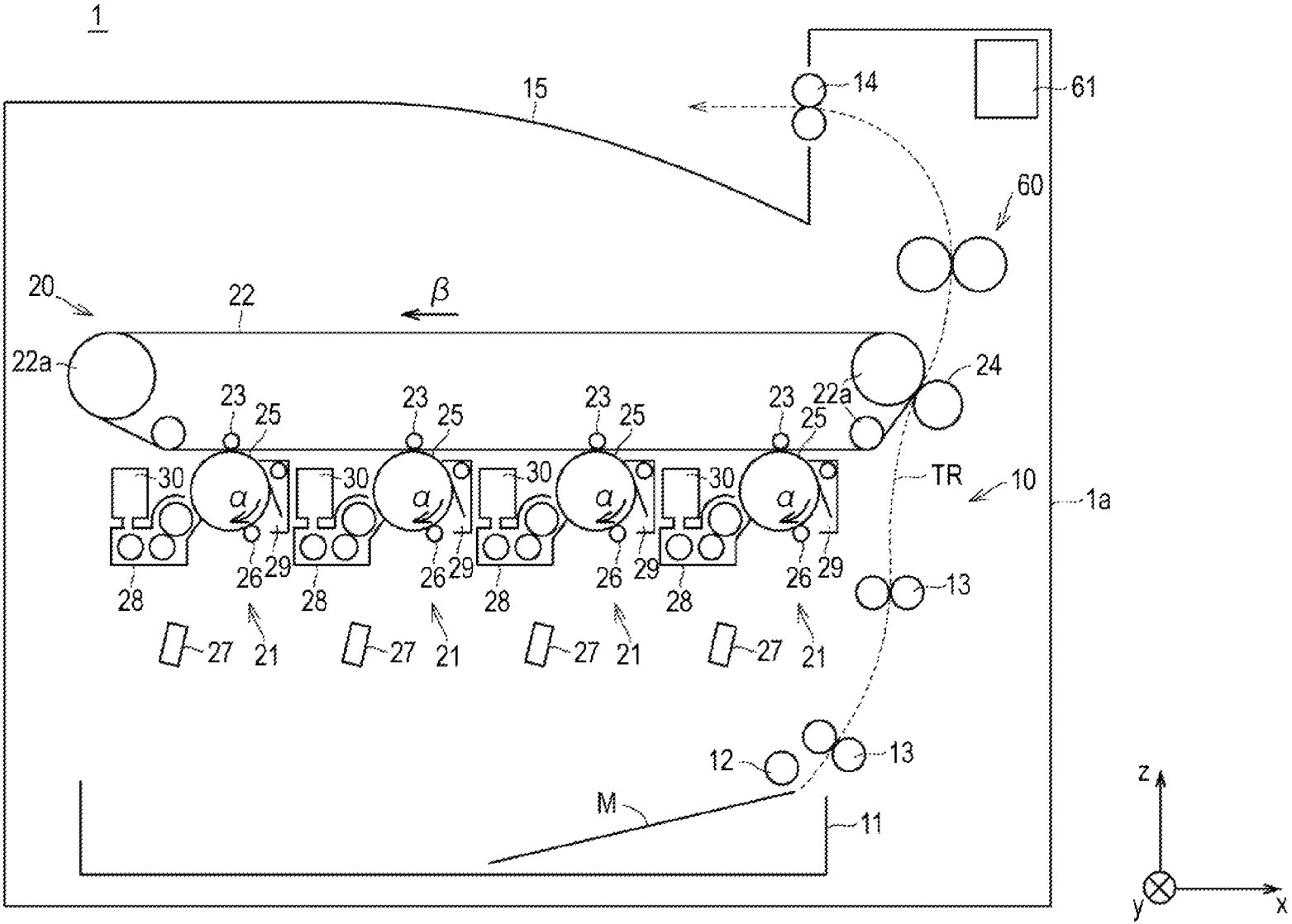
FIG. 1 is a cross-sectional view illustrating a configuration of an image forming apparatus in one embodiment of the invention.

FIG. 1 is a cross-sectional view illustrating a configuration of an image forming apparatus 1 in one embodiment of the invention.

Referring to FIG. 1, the image forming apparatus 1 in the present embodiment is a small-sized or medium-sized MFP, and includes a paper transporting system 10, a toner image former 20 (one example of image formers), a fixing device 60, and a motor 61.

The paper transporting system 10 transports a sheet of paper M (one example of recording media) along a transportation route TR. The paper transporting system 10 includes a paper feeding tray 11, a paper feeding roller 12, a plurality of transporting rollers 13, a paper discharging roller 14, and a paper discharging tray 15. The paper feeding tray 11 accommodates the paper M for forming an image. A plurality of paper feeding trays 11 may be provided. The paper feeding roller 12 is provided between the paper feeding tray 11 and the transportation route TR. Each of the plurality of transporting rollers 13 is provided along the transportation route TR. The paper discharging roller 14 is provided at the most downstream part of the transportation route TR. The paper discharging tray 15 is provided at the uppermost part of an image forming apparatus body 1*a*.

The toner image former 20 forms a toner image on the transported paper M by, in a so-called tandem process, combining images of four colors: yellow (Y); magenta (M); cyan (C); and black (K). The toner image former 20 includes an image forming unit 21 for each color YMCK, an intermediate transfer belt 22, a primary transfer roller 23 for each color YMCK, a secondary transfer roller 24, and a toner container (toner cartridge) 30 (one example of developer supplying devices) for each color YMCK.

The image forming unit 21 for each color YMCK includes a photoreceptor drum 25, a charging roller 26, an exposing device 27, a developing device 28, and a cleaning device 29. The photoreceptor drum 25 is rotationally driven in a direction indicated by an arrow $\alpha$ in FIG. 1. The charging roller 26, the developing device 28, and the cleaning device 29 are provided around the photoreceptor drum 25. The charging roller 26 is provided near the photoreceptor drum 25. The exposing device 27 is provided below the photoreceptor drum 25.

The intermediate transfer belt 22 is provided above the image forming unit 21 for each color YMCK. The intermediate transfer belt 22 is annular, and wound around rotating rollers 22*a*. The intermediate transfer belt 22 is rotationally driven in a direction indicated by an arrow $\beta$ in FIG. 1. Each of the primary transfer rollers 23 faces each of the photoreceptor drums 25 with the intermediate transfer belt 22 interposed therebetween. The secondary transfer roller 24 is in contact with the intermediate transfer belt 22 in the transportation route TR.

The toner container 30 is provided above the developing device 28. The toner container 30 is removable from the image forming apparatus body 1*a* through a door (not illustrated) provided on, for example, the front surface of the image forming apparatus body 1*a*. The toner container 30 contains toner. The interior of the toner container 30 is directly connected to the interior of the developing device 28 without interposing a toner reservoir such as a hopper.

The fixing device 60 fixes a toner image on the paper M by, while gripping the paper carrying the toner image, transporting the paper along the transportation route TR.

The motor 61 applies power to each member of the image forming apparatus 1.

The image forming apparatus 1 rotates the photoreceptor drum 25, and charges the surface of the photoreceptor drum 25 with the charging roller 26. In the image forming apparatus 1, the exposing device 27 exposes the surface of the charged photoreceptor drum 25 based on image forming information, and an electrostatic latent image is formed on the surface of the photoreceptor drum 25.

The image forming apparatus 1 then feeds toner from the developing device 28 to the photoreceptor drum 25 on which the electrostatic latent image is formed, performs development, and forms a toner image on the surface of the photoreceptor drum 25.

Then, in the image forming apparatus 1, the primary transfer roller 23 sequentially transfers the toner image formed on the photoreceptor drum 25 to the surface of the intermediate transfer belt 22 (primary transfer). In a full-color image, a toner image in which toner images of each color YMCK are combined is formed on the surface of the intermediate transfer belt 22.

In the image forming apparatus 1, the cleaning device 29 removes toner that remains on the photoreceptor drum 25 without being transferred to the intermediate transfer belt 22.

Then, in the image forming apparatus 1, the rotating roller 22*a* transports the toner image formed on the surface of the intermediate transfer belt 22 to the position facing the secondary transfer roller 24.

Meanwhile, the image forming apparatus 1 supplies the paper M accommodated in the paper feeding tray 11 with the paper feeding roller 12, and guides the paper M between the intermediate transfer belt 22 and the secondary transfer roller 24 along the transportation route TR with each of the plurality of transporting roller 13. Then, in the image forming apparatus 1, the secondary transfer roller 24 transfers the toner image formed on the surface of the intermediate transfer belt 22 to the paper M.

The image forming apparatus 1 guides to the fixing device 60 the paper M on which the toner image has been transferred, and fixes the toner image on the paper M with the fixing device 60. The image forming apparatus 1 then discharges the paper M on which the toner image has been fixed, to the paper discharging tray 15 with the paper discharging roller 14.

When toner in any developing device 28 is reduced due to the image formation, the image forming apparatus 1 supplies toner (one example of developers) from the toner container 30 for a color corresponding to the developing device 28 to the developing device 28 (one example of subjects to be supplied). The toner image former 20 forms a toner image on a recording medium with toner supplied through the toner container 30.

Then, a configuration of the toner container 30 in the embodiment will be described.

Figure 2:
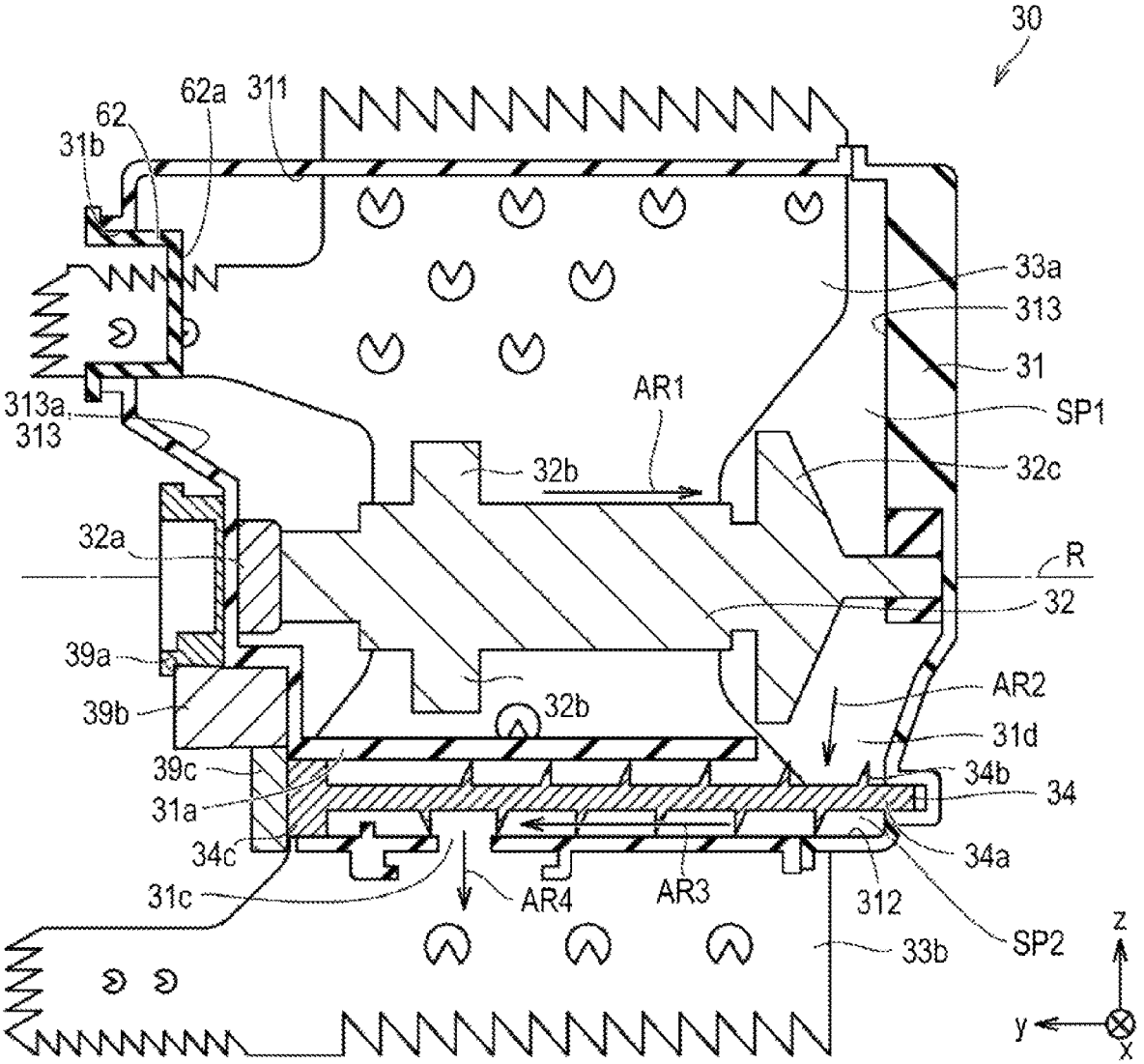
FIG. 2 is a cross-sectional view illustrating a configuration of a toner container in one embodiment of the invention.
Figure 3:
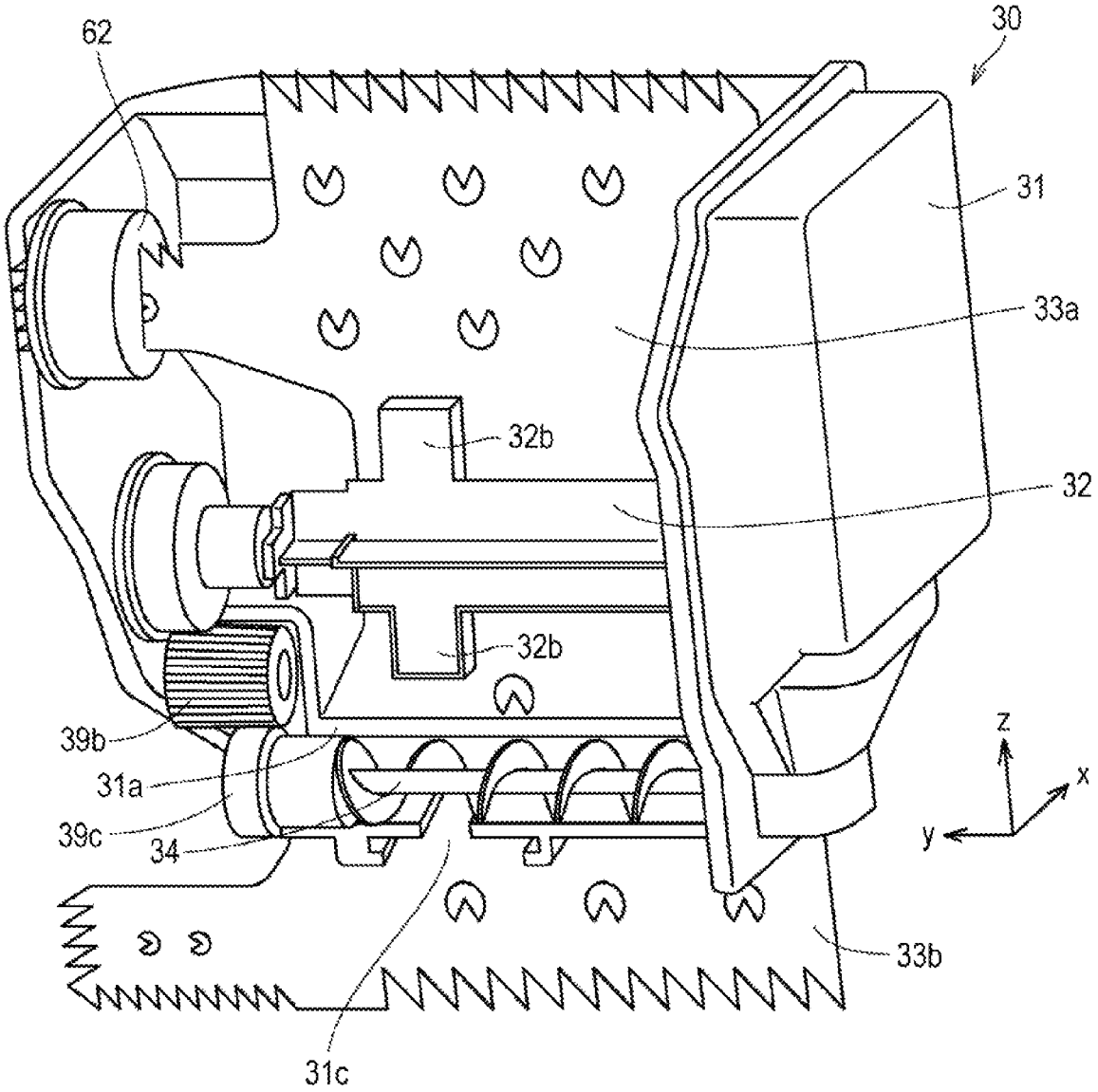
FIG. 3 is a perspective view illustrating a main configuration of an interior of a housing of the toner container in one embodiment of the invention.

FIG. 2 is a cross-sectional view illustrating a configuration of the toner container 30 in one embodiment of the invention. FIG. 3 is a perspective view illustrating a main configuration of an interior of a housing 31 of the toner container 30 in one embodiment of the invention. Note that, in FIGS. 2 and 3, stirring members 33*a* and 33*b* that are not bent are illustrated. The stirring members 33*a* and 33*b* are actually bent in the housing 31 by a force applied from the inner wall surface of the housing 31

Referring to FIGS. 2 and 3, the toner container 30 includes the housing 31, a shaft member 32, the stirring members 33*a* and 33*b*, a transporting member (transporting screw) 34, and power transmitting members 39*a*, 39*b*, and 39*c*.

The housing 31 is almost rectangular, and the inner wall surface of the housing 31 includes a ceiling surface 311, a bottom surface 312, and four side surfaces 313 present between the ceiling surface 311 and the bottom surface 312. The housing 31 includes a partition wall 31*a*, an injection port 31*b*, a discharge port 31*c*, and a communication port 31*d*. The partition wall 31*a* projects from the side surface 313 into the housing 31, and separates the interior of the housing 31 into upper space SP1 and lower space SP2. The injection port 31*b* is formed on the side surface 313 facing the space SP1. A part of the side surface 313 in which the injection port 31*b* is formed projects into the housing 31. The injection port 31*b* is an opening for filling the housing 31 with toner. A cap 62 is fitted into the injection port 31*b* to prevent leakage of toner except when the toner container 30 is filled with toner (although, in FIGS. 2 and 3, the stirring member 33*a* seems to be inserted into the cap 62, the stirring members 33*a* and 33*b* actually come in contact with a bottom part 62*a* of the cap 62 when passing through a position of the cap 62, and are much more bent). The discharge port 31*c* is formed on the bottom surface 312 of the housing 31 in the space SP2. The discharge port 31*c* is an opening for supplying toner in the housing 31 to the developing device 28 by discharging the toner to the outside of the housing 31, and can be opened and closed by a predetermined operation.

The shaft member 32 is provided in the space SP1. The shaft member 32 is rod-shaped, and both ends thereof in an extending direction are rotatably supported to the housing 31. The shaft member 32 includes four projecting parts 32*b* and a tapered part 32*c*. Each of the four projecting parts 32*b* projects locally in a direction away from a rotational axis R in a direction parallel with the rotational axis R. The four projecting parts 32*b* are provided at positions that are, when the center in a direction parallel with the rotational axis R of the shaft member 32 in the housing 31 is defined as a reference, opposite to the side where the communication port 31*d* is present (left in FIG. 2). The four projecting parts 32*b* serve to, while stirring toner in the space SP1, transport the toner in a direction indicated by an arrow AR1. The tapered part 32*c* projects locally in a direction away from the rotational axis R in a direction parallel with the rotational axis R, and the diameter thereof decreases in a direction indicated by the arrow AR1. The tapered part 32*c* serves to, while stirring toner in the space SP1, transport the toner into the space SP2 through the communication port 31*d* as indicated by an arrow AR2.

The stirring members 33*a* and 33*b* are fixed to the shaft member 32 in the space SP1. The stirring members 33*a* and 33*b* can rotate together with the shaft member 32 around the rotational axis R in the housing 31. The stirring members 33*a* and 33*b* stir toner in the space SP1, and serve to remove toner deposited on the inner wall surface of the housing 31. Detailed configurations of the stirring members 33*a* and 33*b* will be described later.

The transporting member 34 is provided in the space SP2. The transporting member 34 is a screw, and includes a rotational shaft 34*a* and impellers 34*b*. The rotational shaft 34*a* is rod-shaped, and both ends thereof in an extending direction are rotatably supported to the housing 31. The impeller 34*b* is provided on the outer peripheral surface of the rotational shaft 34*a*, and has a spiral shape. The transporting member 34 rotates in the space SP2, consequently transports toner in the space SP2 toward the discharge port 31*c* as indicated by an arrow AR3, and discharges the toner to the outside of the housing 31 through the discharge port 31*c* as indicated by an arrow AR4.

The power transmitting members 39*a*, 39*b*, and 39*c* transmit power (rotational force) of the motor 61 of the image forming apparatus 1 to the shaft member 32 and the transporting member 34. Each of the power transmitting members 39*a*, 39*b*, and 39*c* is a gear, and a plurality of teeth is formed on the outer peripheral surface of each of the power transmitting members 39*a*, 39*b*, and 39*c*. One end 32*a* of the shaft member 32 projects outside the housing 31, and is coupled to the power transmitting member 39*a*. One end 34*c* of the transporting member 34 projects outside the housing 31, and is coupled to the power transmitting member 39*c*. The power transmitting member 39*b* engages with each of the power transmitting members 39*a* and 39*c*. An output shaft (not illustrated) of the motor 61 is mounted to the power transmitting member 39*a*.

Power of the motor 61 is transmitted to the power transmitting member 39*a*. The power transmitting member 39*a* is rotated by the power applied from the motor 61. The shaft member 32, and the stirring members 33*a* and 33*b* rotate together with the power transmitting member 39*a*. In addition, the power transmitted from the motor 61 to the power transmitting member 39*a* is transmitted to the power transmitting member 39*c* via the power transmitting member 39*b*. This enables the power transmitting member 39*c* to rotate. The transporting member 34 rotates together with the power transmitting member 39*c*.

The configurations of the stirring members 33*a* and 33*b* will now be described in detail.

Since the stirring members 33*a* and 33*b* have the same configuration, the stirring members 33*a* and 33*b* will be hereinafter sometimes referred together to as the stirring member 33. The stirring members 33*a* and 33*b* may have different configurations. The toner container 30 includes any number of the stirring members 33.

Figure 4:
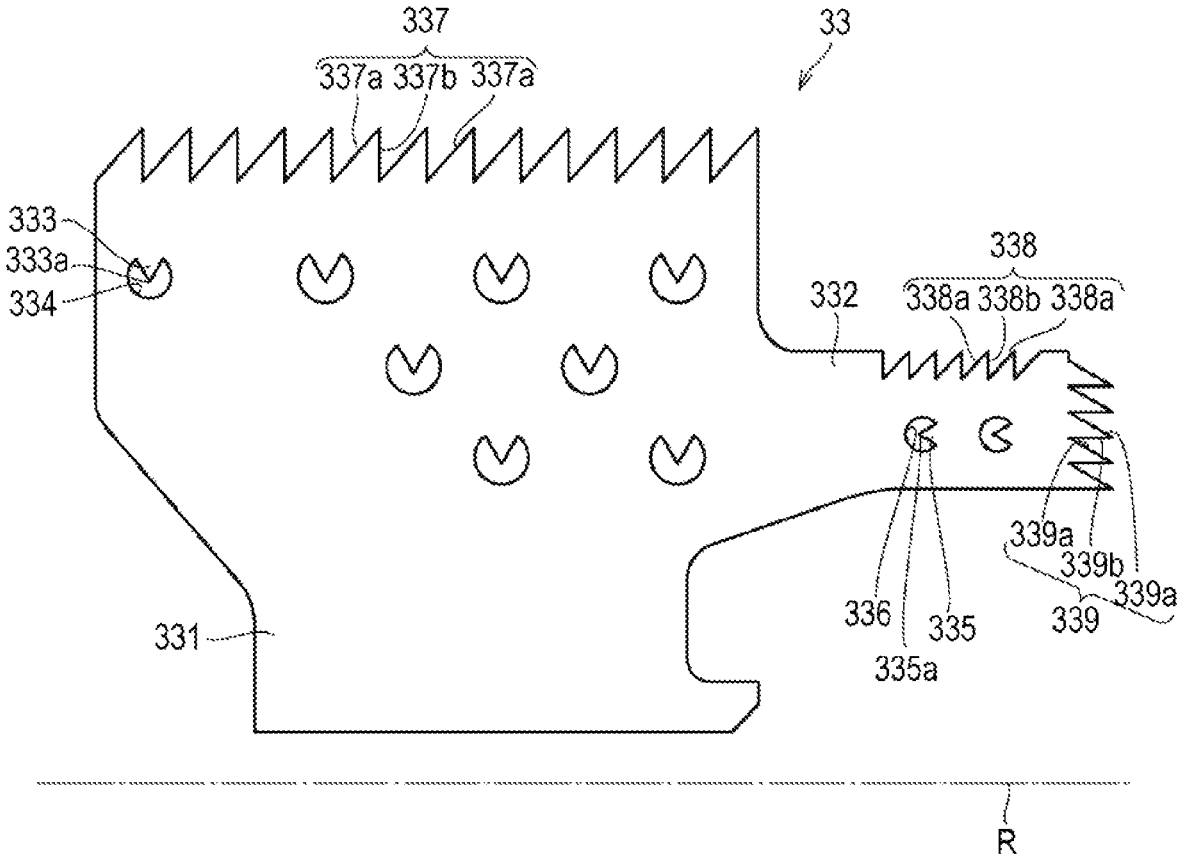
FIG. 4 is a plan view illustrating a configuration of a stirring member in one embodiment of the invention.

FIG. 4 is a plan view illustrating a configuration of the stirring member 33 in one embodiment of the invention. FIGS. 4, 10 to 17, and 19 illustrate the stirring members 33 that are not bent. The stirring members 33 are actually bent in the housing 31 by a force applied from the inner wall surface of the housing 31.

Referring to FIGS. 2 to 4, the stirring member 33 includes a main body 331, an arm 332, cut parts 333 and 335, apertures 334 and 336, a main body tip 337, and arm tips 338 and 339.

The main body 331 is made of a flexible sheet. The main body 331 extends in a direction away from the rotational axis R, and is in contact with the inner wall surface of the housing 31. During rotation of the stirring member 33, the main body 331 comes in contact with the ceiling surface 311, the bottom surface 312, and two side surfaces 313 different from surfaces 313 to which both ends of the shaft member 32 are supported. The main body 331 is bent by contact with the inner wall surface of the housing 31.

The arm 332 is made of a flexible sheet. The arm 332 extends in parallel with the rotational axis R from the main body 331, and is in contact with the inner wall surface of the housing 31. During rotation of the stirring member 33, the arm 332 comes in contact with a side surface 313*a* provided with the cap 62 among the four side surfaces 313. The arm 332 is bent by contact with the inner wall surface of the housing 31. Note that, the arm 332 is required at least to be bent by contact with the inner wall surface of the housing 31 during at least a part of time during which the stirring member 33 rotates once (e.g., while being in contact with the bottom part 62*a*).

The cut part 333 is formed in the main body 331. The cut part 333 projects from the main body 331 when the main body 331 is bent by contact with the inner wall surface of the housing 31 along with rotation of the stirring member 33. The circular aperture 334 surrounds the cut part 333 in the main body 331. The cut part 333 includes a projecting tip 333*a* that projects from the main body 331 (or a portion fixed to the main body 331).

The cut part 335 is formed in the arm 332. The cut part 335 projects from the arm 332 when the arm 332 is bent by contact with the inner wall surface of the housing 31 along with rotation of the stirring member 33. The circular aperture 336 surrounds the cut part 335 in the main body 331.

The cut part 335 includes a projecting tip 335*a* that projects from the arm 332. When the arm 332 is not bent, the projecting tip 335*a* preferably has a projecting shape in a direction parallel with the rotational axis R. Since a direction in which the arm 332 is bent is tilted at 90 degrees to a direction in which the main body 331 is bent, the projection direction of the projecting tip 335*a* is preferably tilted at 90 degrees to a projection direction of the projecting tip 333*a*.

The main body tip 337 is present in a direction perpendicular to the rotational axis R in the main body 331. The main body tip 337 includes a plurality of sides 337*a* and sides 337*b*. The sides 337*a* are tilted in parallel with each other to the rotational axis R. The sides 337*b* are provided between the plurality of sides 337*a*, and are perpendicular to the rotational axis R. In FIG. 4, the length of the side 337*a* in the direction parallel with the rotational axis R is similar to that of the cut part 333 in the direction parallel with the rotational axis R.

The arm tip 338 is present in a direction perpendicular to the rotational axis R in the arm 332. The arm tip 338 includes a plurality of sides 338*a* and sides 338*b*. The sides 338*a* are tilted in parallel with each other to the rotational axis R. The sides 338*b* are provided between the plurality of sides 338*a*, and are perpendicular to the rotational axis R.

The arm tip 339 is present in a direction parallel with the rotational axis R in the arm 332. The arm tip 339 includes a plurality of sides 339*a* and sides 339*b*. The sides 339*a* are tilted in parallel with each other in a direction perpendicular to the rotational axis R. The sides 339*b* are provided between the plurality of sides 339*a*, and are parallel with the rotational axis R.

Figure 5:
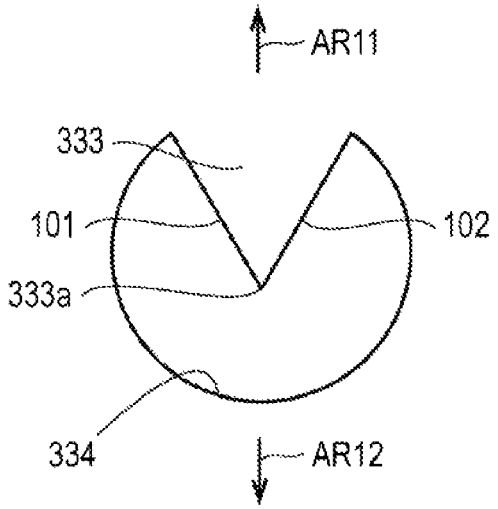
FIG. 5 is an enlarged view illustrating a cut part in FIG. 4.

FIG. 5 is a view illustrating the cut part 333 in FIG. 4 in an enlarged manner.

Referring to FIGS. 2 to 5, the cut part 333 in the embodiment includes two straight cutting lines 101 and 102, and has a V-shape. When the main body 331 is not bent, the projecting tip 333*a* preferably has a projecting shape in a direction perpendicular to the rotational axis R (direction indicated by an arrow AR11 or AR12). Consequently, when the main body 331 is bent by contact with the inner wall surface of the housing 31 along with rotation of the stirring member 33, the projecting tip 333*a* projects in parallel with a rotational direction of the stirring member 33, and a force acting on toner deposited on the inner wall surface of the housing 31 can be increased. In particular, when the main body 331 is not bent, the projecting tip 333*a* more preferably has a projecting shape in a direction from the main body tip 337 toward the rotational axis R (direction indicated by the arrow AR12). Consequently, during rotation of the stirring member 33, the projecting tip 333*a* projects in the same direction as the rotational direction, and thus a force acting on toner deposited on the inner wall surface of the housing 31 can be further increased.

Effects of the toner container 30 in the embodiment will now be described.

Figure 6:
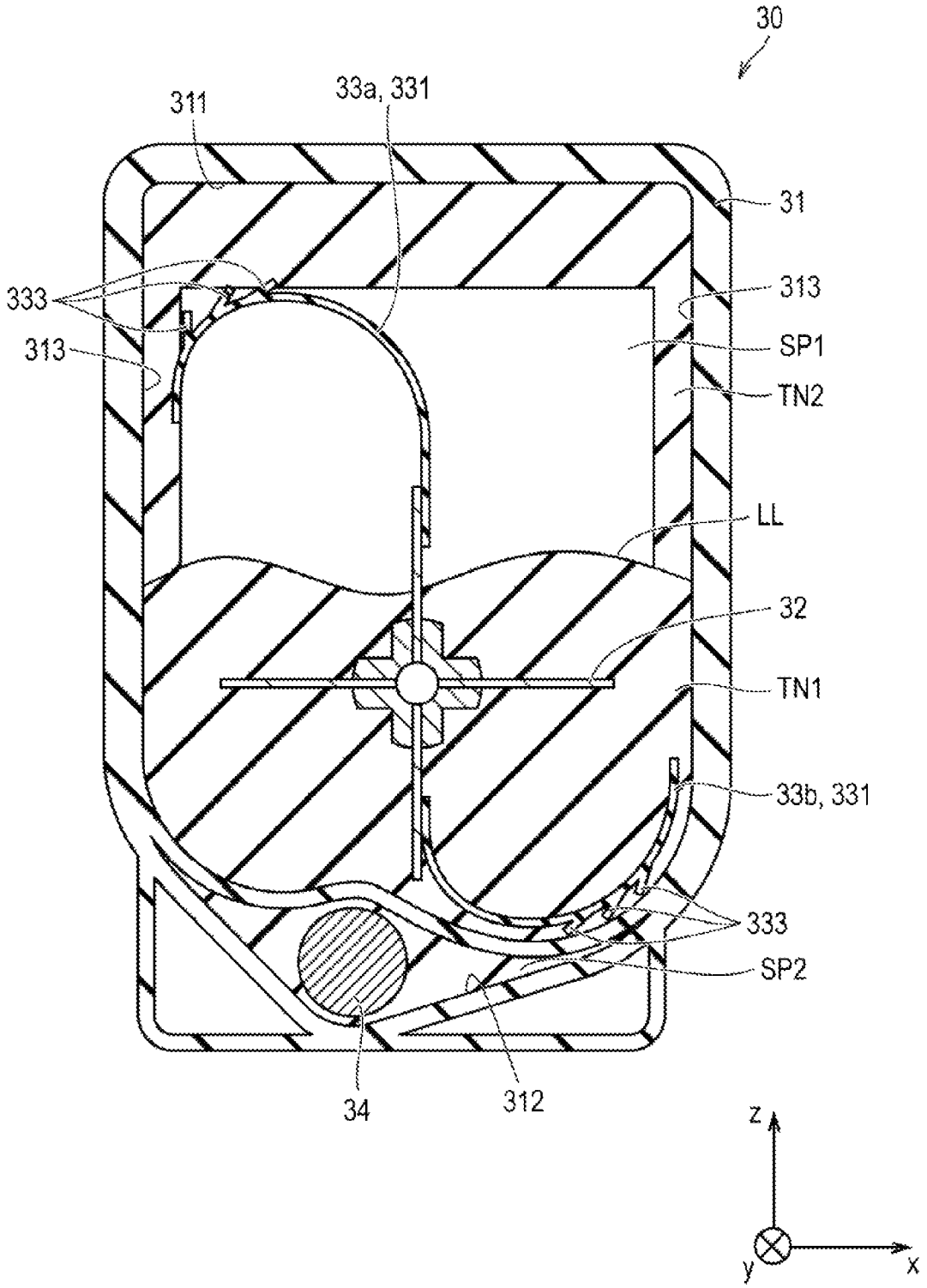
FIG. 6 is a cross-sectional view illustrating the stirring member in the toner container in one embodiment of the invention.
Figure 7:
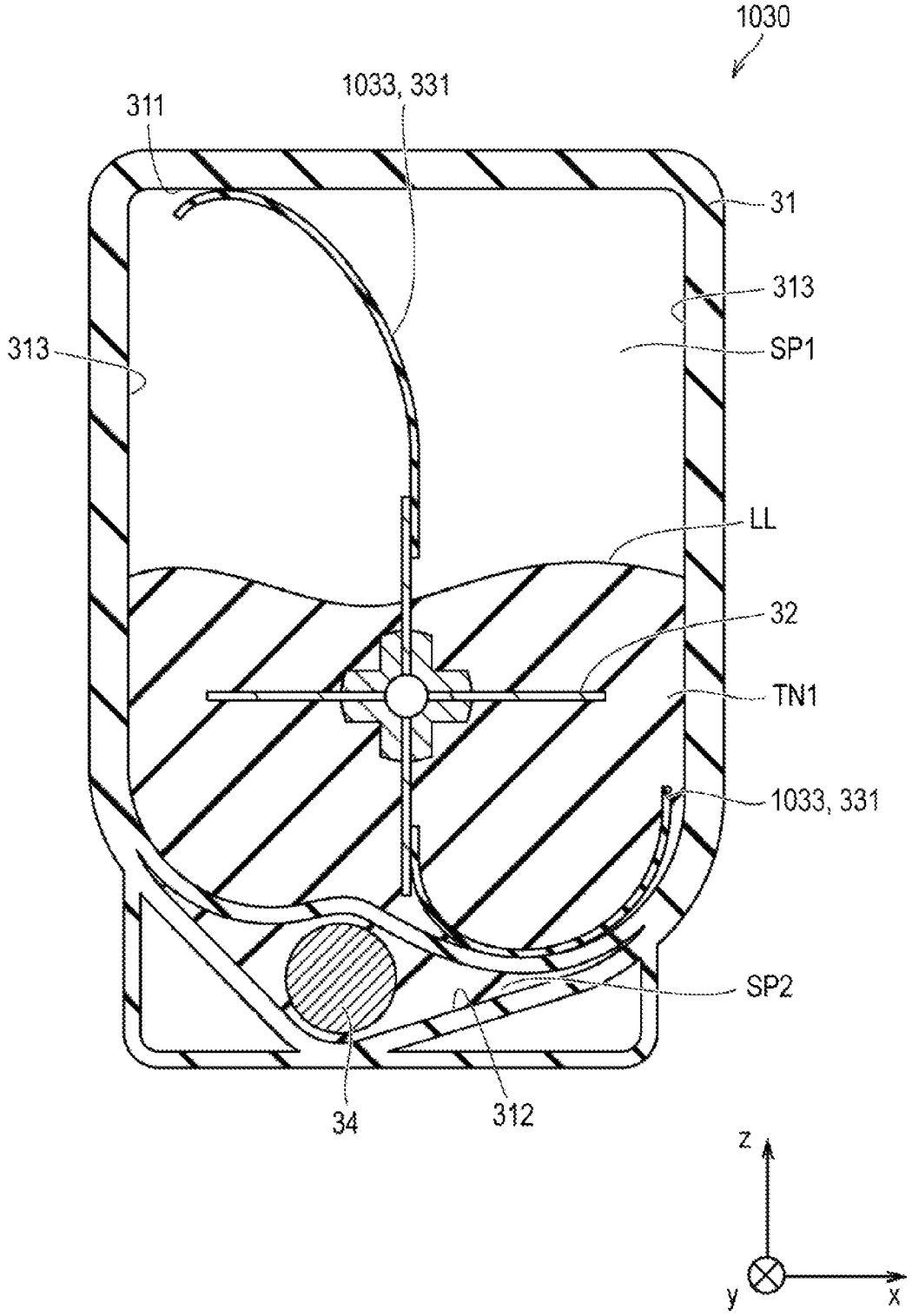
FIG. 7 (PRIOR ART)
FIG. 7 is a cross-sectional view illustrating a stirring member in a toner container in a comparative example, the view illustrating the stirring member with toner not being deposited on the inner wall surface of space.
Figure 8:
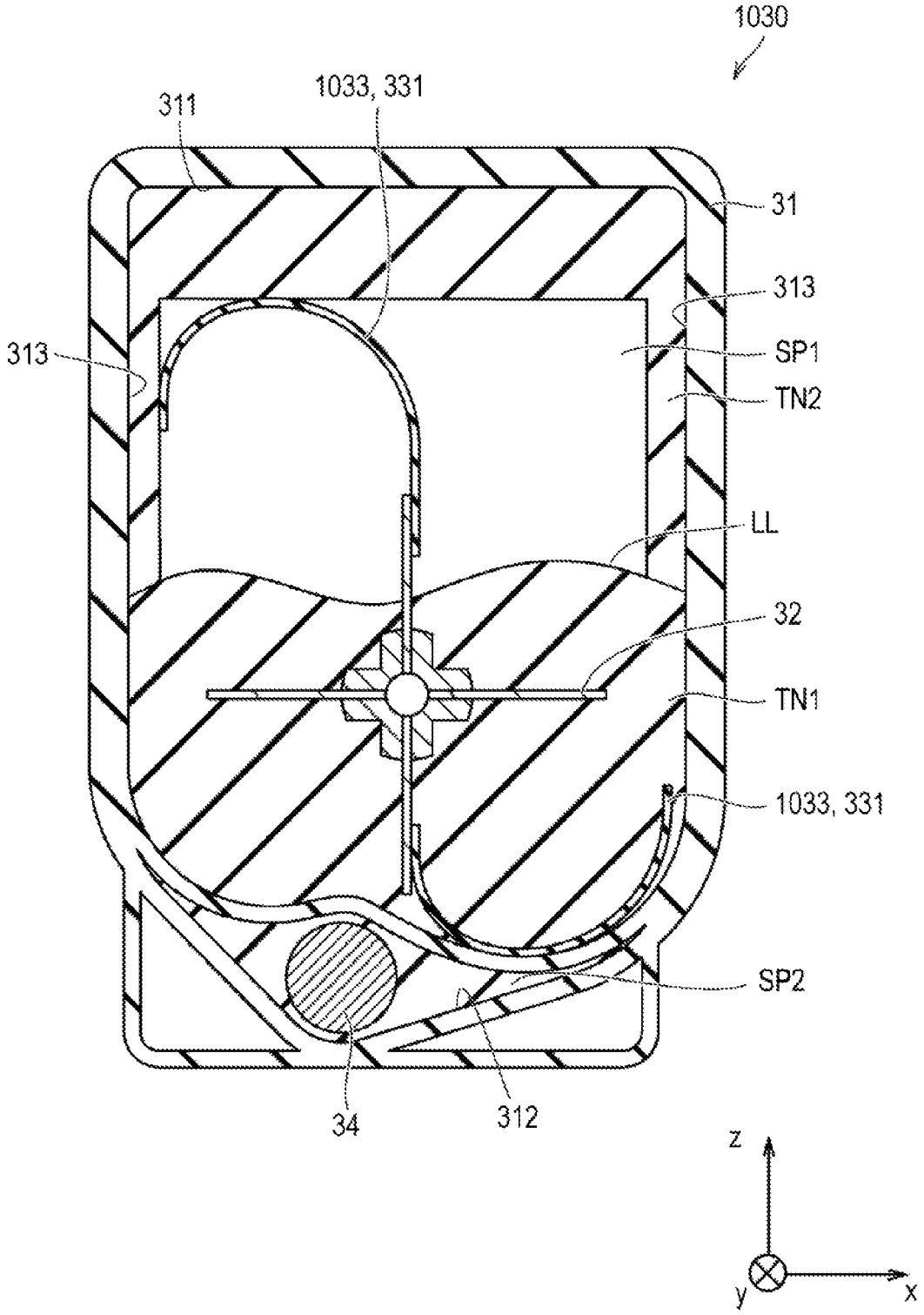
FIG. 8 (PRIOR ART)
FIG. 8 is a cross-sectional view illustrating the stirring member in the toner container in a comparative example, the view illustrating the stirring member with toner deposited on the inner wall surface of space.

FIG. 6 is a cross-sectional view illustrating the stirring member 33 in the toner container 30 in one embodiment of the invention. FIGS. 6 to 8 illustrate a cross-section taken along a plane orthogonal to the rotational axis R.

Referring to FIG. 6, here, among toner contained in the housing 31, toner that is not deposited on the inner wall surface of the housing 31 (toner movable in the housing 31) is referred to as toner TN1, and toner deposited on the inner wall surface of the housing 31 is referred to as toner TN2. The toner TN1 has a liquid level LL (overlapping portion with the toner TN2 of the liquid level LL is indicated by a dotted line).

When the toner container 30 is stored under a severe environment, toner in the toner container 30 tends to flocculate. In particular, when the toner container 30 is stored with the transporting member 34 placed downward before mounted into the image forming apparatus 1, the flocculated toner tends to deposit on the inner wall surface in the space SP2 (i.e., the bottom surface 312 and the lower portions of the side surfaces 313). In this case, the flocculated toner may block rotation of the transporting member 34, so that toner cannot be supplied from the toner container 30. Therefore, the toner container 30 is constituted, for example in shape, to be easily stored generally with the transporting member 34 placed upward (with the toner container 30 in FIG. 6 turned upside down) during storage before mounted into the image forming apparatus 1.

Meanwhile, when the toner container 30 is stored with the transporting member 34 placed upward, the flocculated toner tends to deposit on the inner wall surface in the space SP1 (i.e., the ceiling surface 311 and the upper portions of the side surfaces 313). According to the embodiment, the main body 331 is bent by contact with the inner wall surface of the housing 31 or the toner TN2, and the cut part 333 is projected from the main body 331. The projected cut part 333 moves, while being in contact with the surface of the toner TN2, along with rotation of the stirring member 33, and shaves the toner TN2 off the inner wall surface in the space SP1. The larger thickness of the toner TN2 deposited on the inner wall surface in the space SP1 much more bends the main body 331, and thus a force to shave the toner TN2 off the inner wall surface in the space SP1 is increased. As a result, the toner deposited on the inner wall surface of the housing 31 can be effectively removed, and toner can be smoothly supplied to the developing device 28.

FIGS. 7 and 8 are a cross-sectional view illustrating the stirring member 1033 in the toner container 1030 in a comparative example. FIG. 7 illustrates the stirring member 1033 with no toner TN2 deposited on the inner wall surface in the space SP1. FIG. 8 illustrates the stirring member 1033 with the toner TN2 deposited on the inner wall surface in the space SP1.

Referring to FIGS. 7 and 8, in the comparative example, the toner container 1030 is assumed to have a similar configuration to the toner container in the embodiment except that the stirring member 1033 has no cut part 333.

Also in the comparative example, the main body 331 is bent by contact with the inner wall surface of the housing 31 or the toner TN2. The main body 331 moves, while being in contact with the surface of the toner TN2, along with rotation of the stirring member 33. In the comparative example, however, the stirring member 1033 has no cut parts and only rubs the surface of the toner TN2 with the curved surface thereof. A force to shave the toner TN2 off the inner wall surface in the space SP1 is thus decreased. As a result, the toner deposited on the inner wall surface of the housing 31 cannot be effectively removed, and toner cannot be smoothly supplied to the developing device 28.

[Variation]

A variation of the cut part 333 will now be described. The cut part 333 may have the following configuration.

FIGS. 9A to 9E illustrate configurations in variations of the cut part 333 in one embodiment of the invention.

Referring to FIGS. 9A to 9E, the cut part 333 of the stirring member 33 is required at least to project from the main body 331 when the main body 331 is bent along with rotation of the stirring member 33, and has any shape. The cut part 333 can have an angular shape, a circular shape, a trapezoidal shape, or a shape in combination thereof.

Figure 9A:
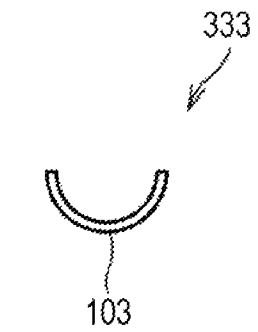
FIGS. 9A to 9E illustrate a configuration in a variation of the cut part in one embodiment of the invention.
Figure 9B:
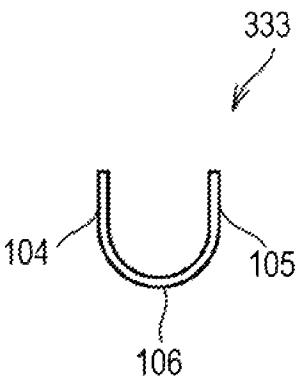
Figure 9C:
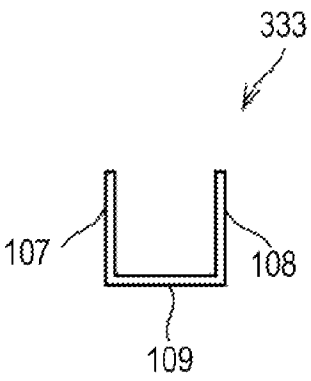
Figure 9D:
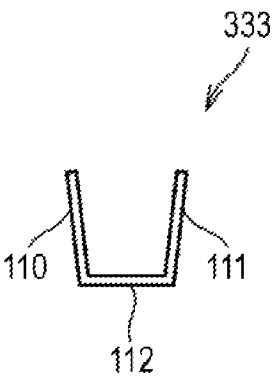
Figure 9E:
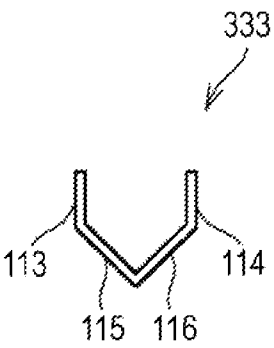

As illustrated in FIG. 9A, the cut part 333 is formed by one arc-shaped (curved) cutting line 103, and may have a semicircular shape. As also illustrated in FIG. 9B, the cut part 333 is formed by two parallel straight cutting lines 104 and 105, and one arc-shaped (curved) cutting line 106 provided therebetween. As also illustrated in FIG. 9C, the cut part 333 is formed by two parallel straight cutting lines 107 and 108, and one straight cutting line 109 provided therebetween. The cut part 333 may have a rectangular shape. As also illustrated in FIG. 9D, the cut part 333 may have two straight cutting lines 110 and 111, and one straight cutting line 112 provided therebetween. The cutting lines 110 and 111 are provided such that a distance therebetween is reduced toward the tip. The cut part 333 may have a trapezoidal shape. As further illustrated in FIG. 9E, the cut part 333 may have two parallel straight cutting lines 113 and 114, and two straight cutting lines 115 and 116 provided therebetween. The cutting lines 115 and 116 constitute a V-shape.

Any cut part 333 illustrated in FIGS. 9A to 9E has two more continuous straight lines, one or more curved lines, or a combination of a straight line and a curved line.

Note that the cut part 335 of the stirring member 33 also has variations similar to the cut part 333. In addition, the cut part 333 and the cut part 335 may be different from each other or the same in shape.

A variation of the stirring member 33 will now be described. The stirring member 33 may have the following configuration.

FIGS. 10 to 17 are plan views illustrating configurations in variations of the stirring member 33 in one embodiment of the invention.

Figure 10:
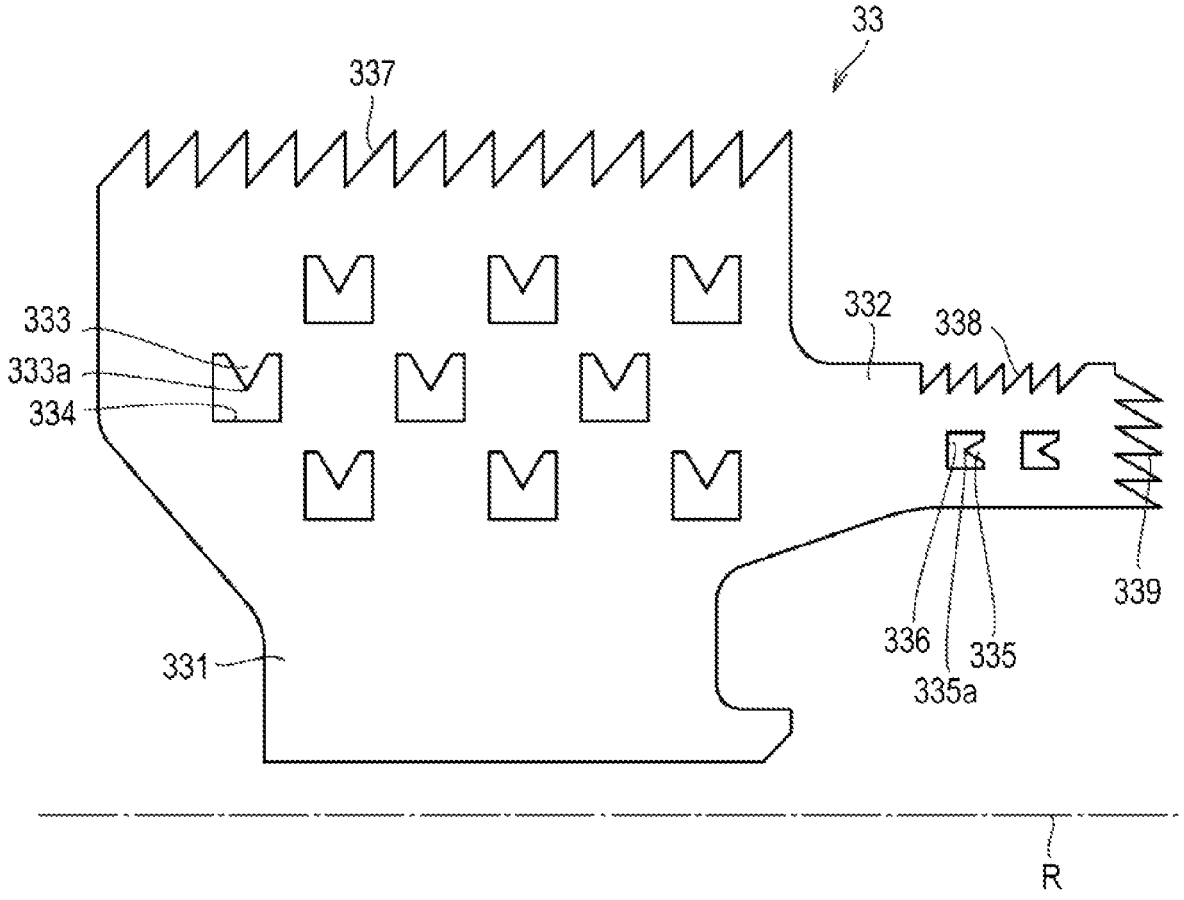
FIG. 10 is a plan view illustrating a configuration in a first variation of the stirring member in one embodiment of the invention.

As illustrated in a first variation in FIG. 10, the rectangular aperture 334 may surround the cut part 333, and the rectangular aperture 336 may surround the cut part 335.

Figure 11:
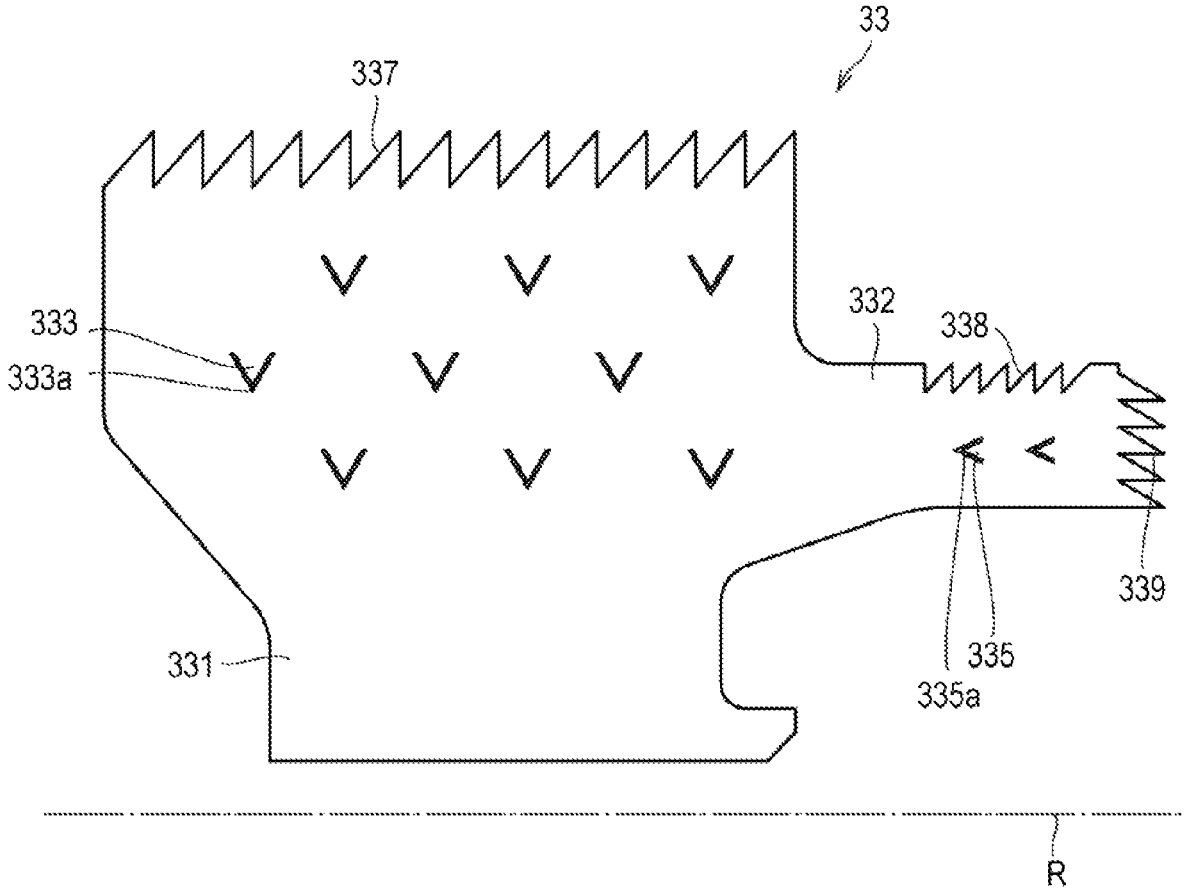
FIG. 11 is a plan view illustrating a configuration in a second variation of the stirring member in one embodiment of the invention.

As illustrated in a second variation in FIG. 11, apertures not necessarily need to surround the cut parts 333 and 335 in the main body 331.

Figure 12:
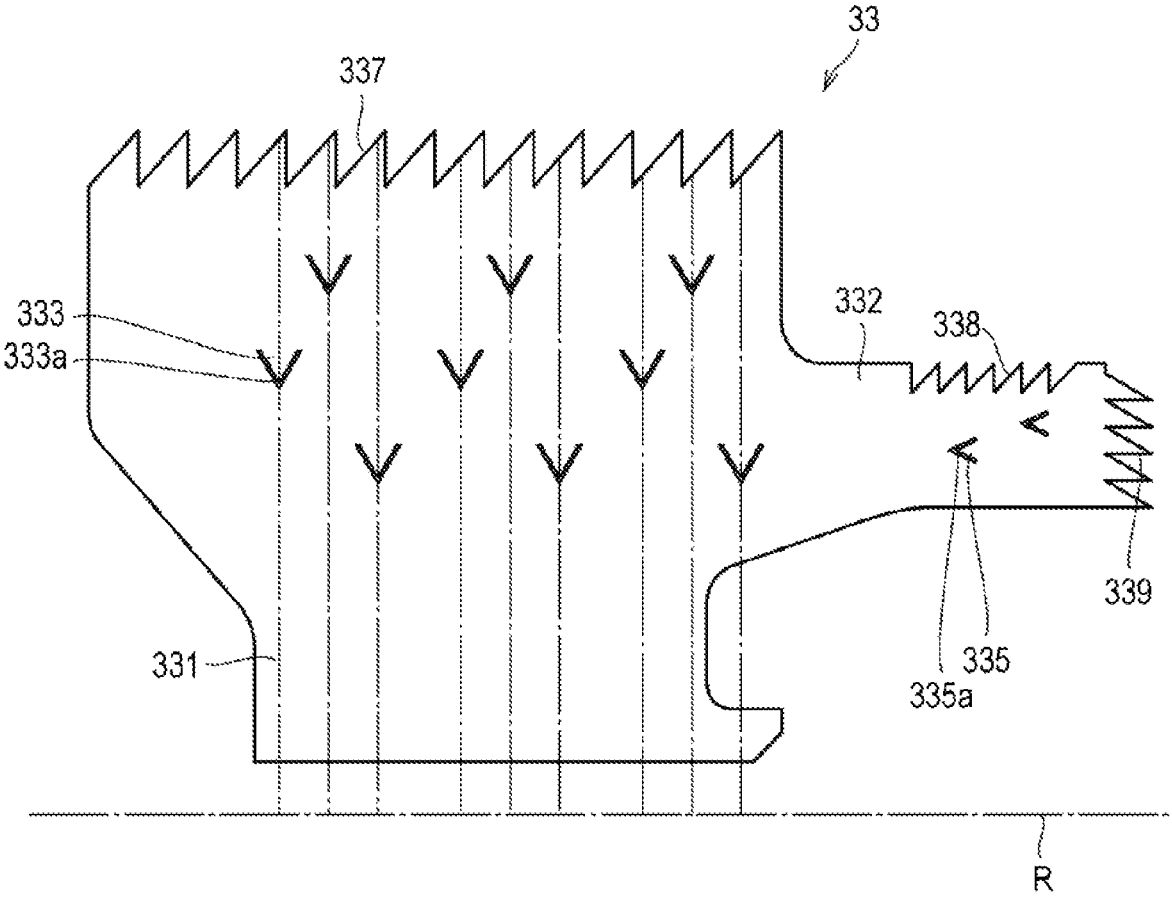
FIG. 12 is a plan view illustrating a configuration in a third variation of the stirring member in one embodiment of the invention.

As illustrated in a third variation in FIG. 12, when a plurality of cut parts 333 is provided, each position of the plurality of cut parts 333 along the rotational axis R (phase in a direction of the rotational axis R) may be different. Here, each of the plurality of the cut parts 333 is formed at nine different positions along the rotational axis R. This enables toner to be removed at different positions along the rotational axis R on the inner wall surface of the housing 31, and toner can be efficiently removed in a wide range.

Figure 13:
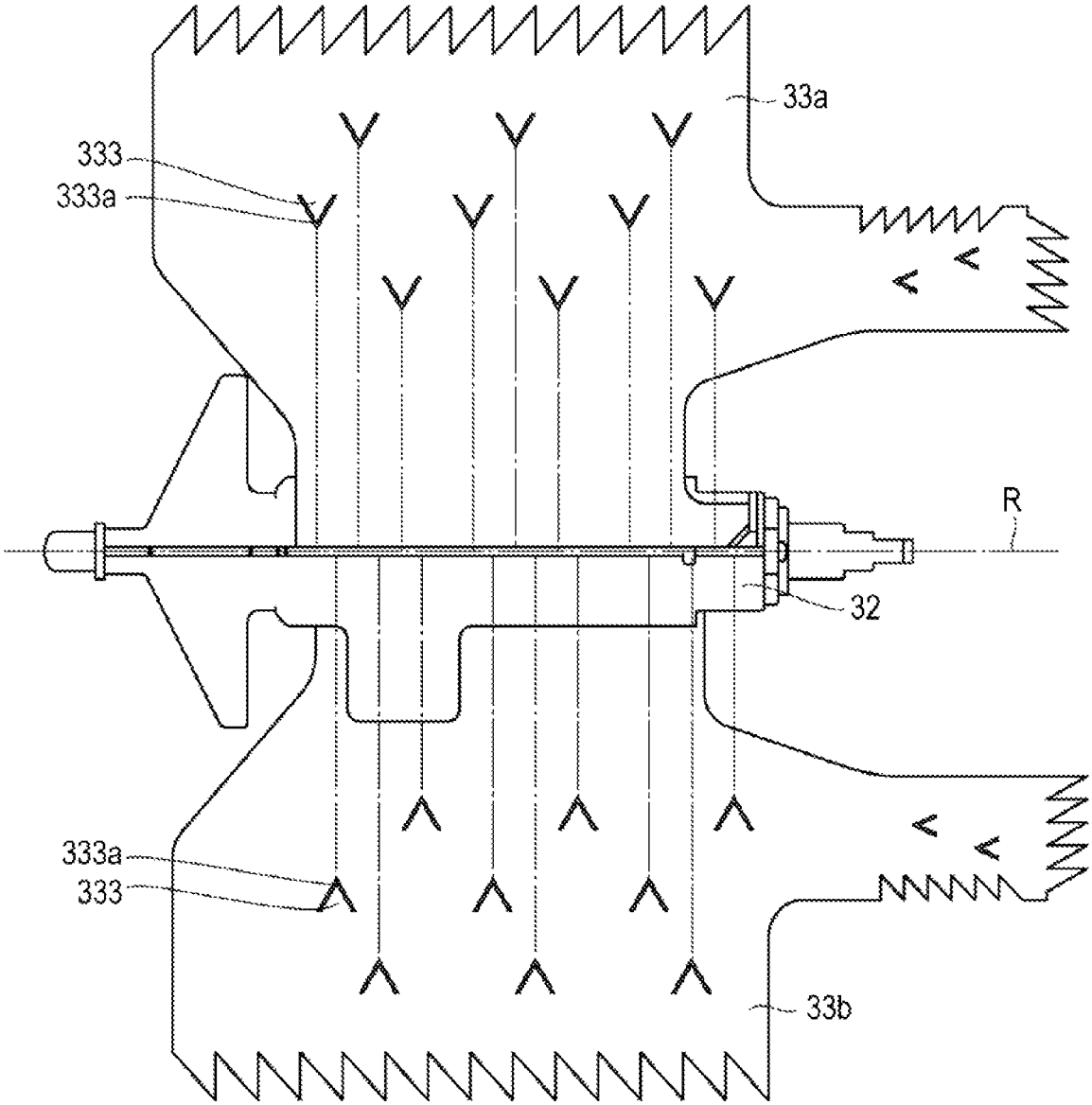
FIG. 13 is a plan view illustrating a configuration in a fourth variation of the stirring member in one embodiment of the invention.

As illustrated in a fourth variation in FIG. 13, when the toner container 30 includes a plurality of (here two) stirring members 33*a* and 33*b*, each position of the cut parts 333 of the stirring members 33*a* and 33*b* along the rotational axis R (phase in the direction of the rotational axis R) may be different. Here, each of the cut parts 333 of the stirring members 33*a* and 33*b* is formed at 18 different positions along the rotational axis R. This enables toner to be removed at different positions along the rotational axis R on the inner wall surface of the housing 31, and toner can be efficiently removed in a wide range.

Figure 14:
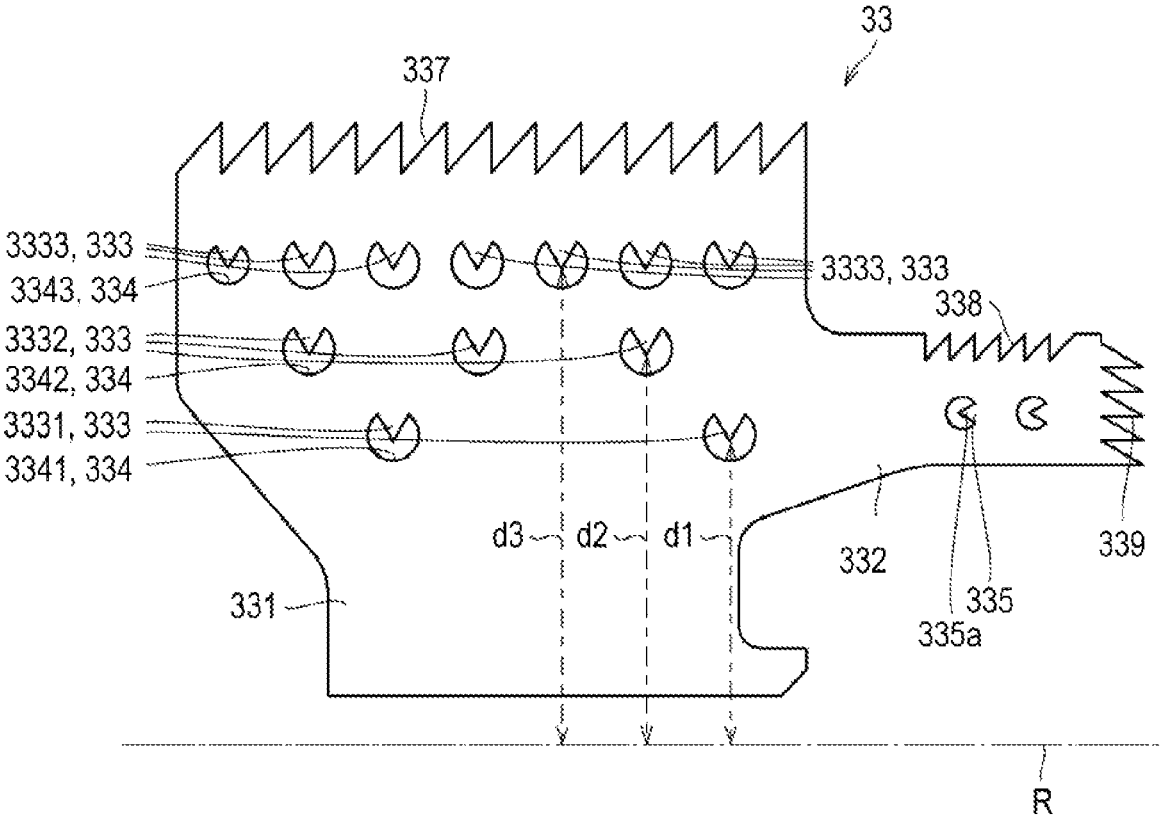
FIG. 14 is a plan view illustrating a configuration in a fifth variation of the stirring member in one embodiment of the invention.

In a fifth variation in FIG. 14, the following is assumed. A plurality of cut parts 333 is provided. The plurality of cut parts 333 includes two cut parts 3331, three cut parts 3332, and seven cut parts 3333. The cut parts 3331 are aligned parallel with the rotational axis Rat a distance d1 from the rotational axis. The cut parts 3332 are aligned parallel with the rotational axis R at a distance d2 (>d1) from the rotational axis. The cut parts 3333 are aligned parallel with the rotational axis R at a distance d3 (>d2) from the rotational axis. The aperture 334 is formed around each cut part 333.

The total area of the apertures 334 formed around the cut parts 3331 (total area of two apertures 3341), the total area of the apertures 334 formed around the cut parts 3332 (total area of three apertures 3342), and the total area of the apertures 334 formed around the cut parts 3333 (total area of seven apertures 3343) may be different. More specifically, the total area of the apertures 3341 formed around the cut parts 3331 may be smaller than that of the apertures 3342 formed around the cut parts 3332. The total area of the apertures 3342 formed around the cut parts 3332 may be smaller than that of the apertures 3343 formed around the cut parts 3333. The total area of the apertures 334 can be adjusted based on whether there is the aperture 334 formed around the cut part 333 or not, or the number or the size of the apertures 334.

In this way, the larger total area of the apertures 334 in a direction parallel with the rotational axis R much more bends the main body 331 at a position, at which the apertures 334 are formed, perpendicular to the rotational axis R. Specifically, the main body 331 is bent at a position of the cut parts 3332 more easily than at a position of the cut parts 3331, and is bent at a position of the cut parts 3333 more easily than at the position of the cut parts 3332. As a result, the main body 331 is easier to bend on the side of the main body tip 337 than on the side of the rotational axis R, and can effectively remove toner deposited on the inner wall surface of the housing 31.

Figure 15:
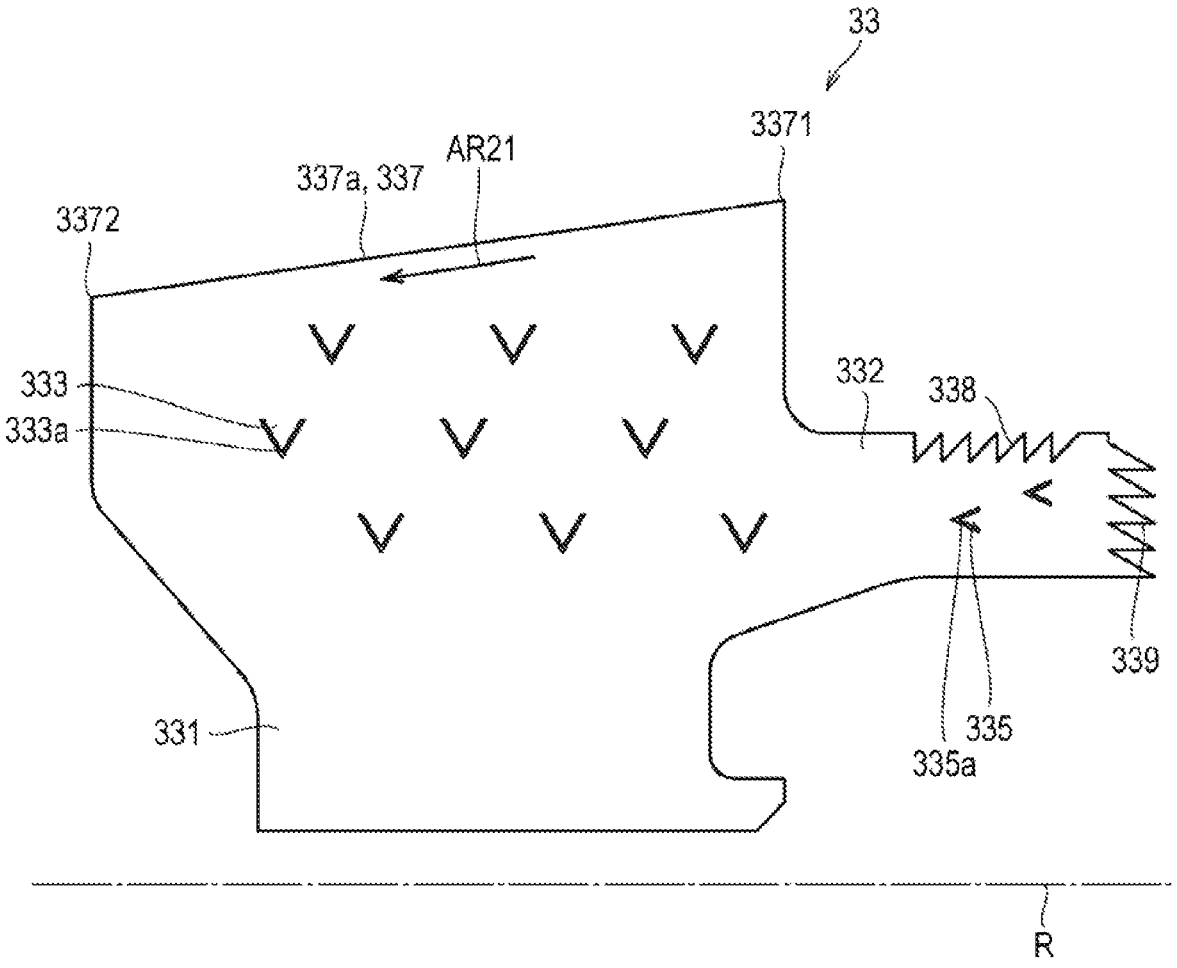
FIG. 15 is a plan view illustrating a configuration in a sixth variation of the stirring member in one embodiment of the invention.

As illustrated in a sixth variation in FIG. 15, the main body tip 337 may be provided with only one side 337*a* tilted to the rotational axis R. Since the main body tip 337 has the side 337*a* tilted to the rotational axis R, the main body 331 is bent in different degrees in a direction parallel with the rotational axis R. Resistance forces of the main body 331 (elastic forces of the main body 331) against forces from the inner wall surface of the housing 31 are thus different in a direction parallel with the rotational axis R. Specifically, the main body tip 337 has a maximum resistance force at a position 3371 farthest from the rotational axis R, and the main body tip 337 has a minimum resistance force at a position 3372 nearest to the rotational axis R. This moves the entire stirring member 33 to the side with lower resistance (left in FIG. 15) as indicated by an arrow AR21. As a result, the position of the cut part 333 varies depending on resistance from the inner wall surface of the housing 31, and the toner-scraping performance of the stirring member 33 is improved.

Figure 16:
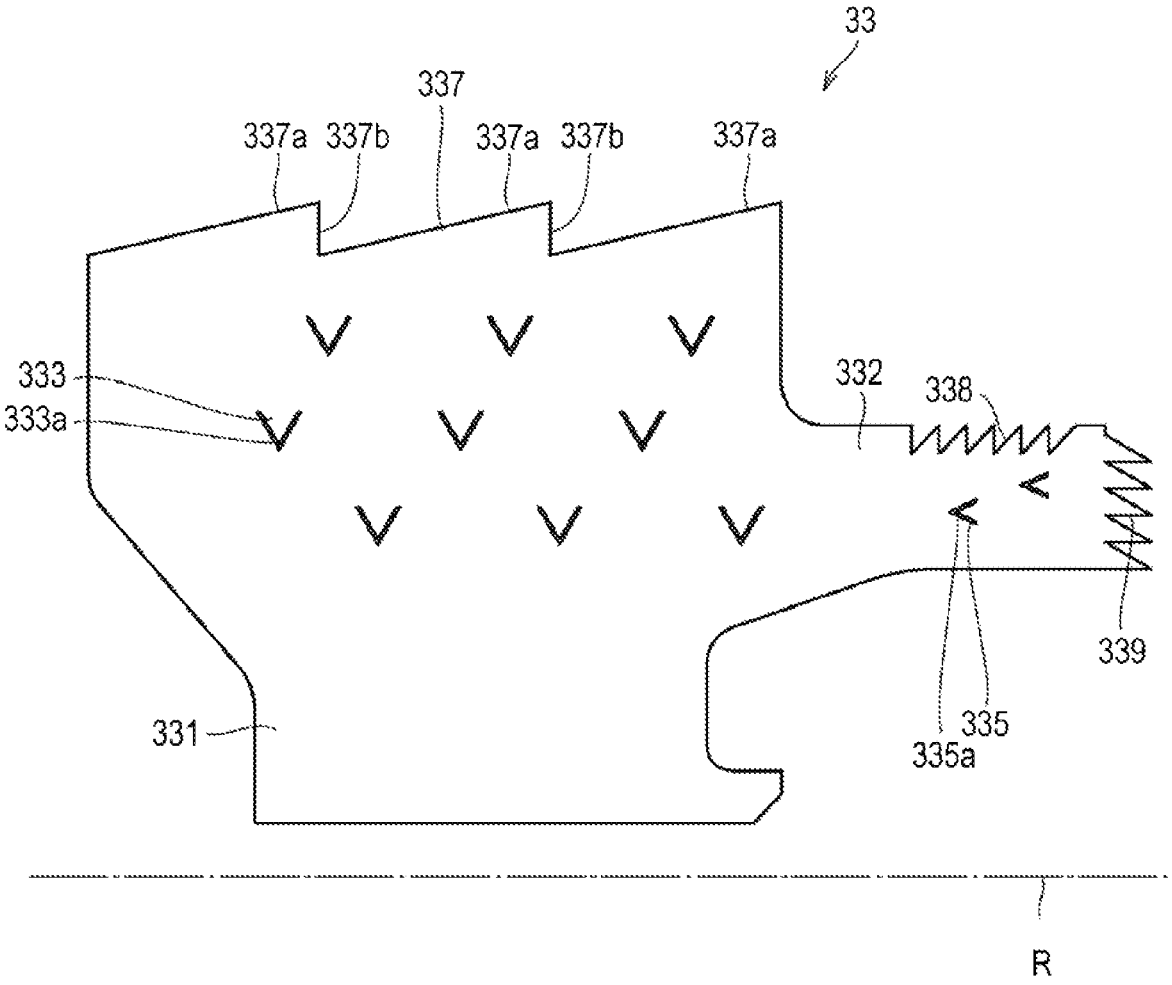
FIG. 16 is a plan view illustrating a configuration in a seventh variation of the stirring member in one embodiment of the invention.
Figure 17:
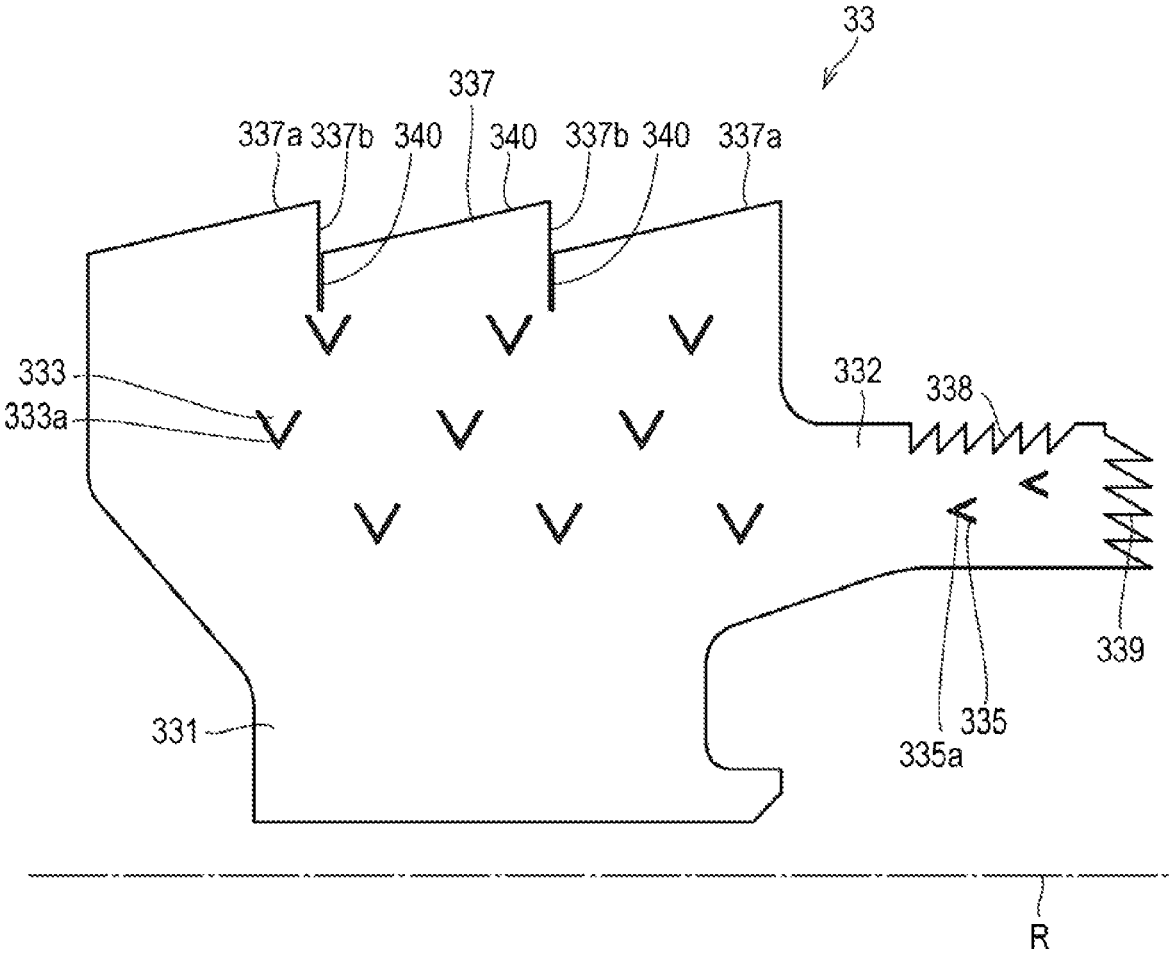
FIG. 17 is a plan view illustrating a configuration in an eighth variation of the stirring member in one embodiment of the invention.

As illustrated in a seventh variation in FIG. 16, and an eighth variation in FIG. 17, the main body tip 337 may have a plurality of (here three) parallel sides 337*a*, and sides 337*b*. The sides 337*a* are tilted to the rotational axis R. The sides 337*b* are provided between the plurality of sides 337*a*, and are perpendicular to the rotational axis R. Similarly to the sixth variation also in this case, the position of the cut part 333 varies depending on resistance from the inner wall surface of the housing 31, and the toner-scraping performance of the stirring member 33 is improved.

In particular, as in the eighth variation in FIG. 17, the stirring member 33 may further include a cut part 340 (one example of other cut parts). In the main body 331, the cut part 340 is provided adjacent to the side 337*b*, which is perpendicular to the rotational axis R, of the main body tip 337. This facilitates independent bending of each of the plurality of sides 337*a*.

A variation of the image forming apparatus 1 and the developer supplying device will now be described. The image forming apparatus 1 and the developer supplying device may have the following configuration.

Figure 18:
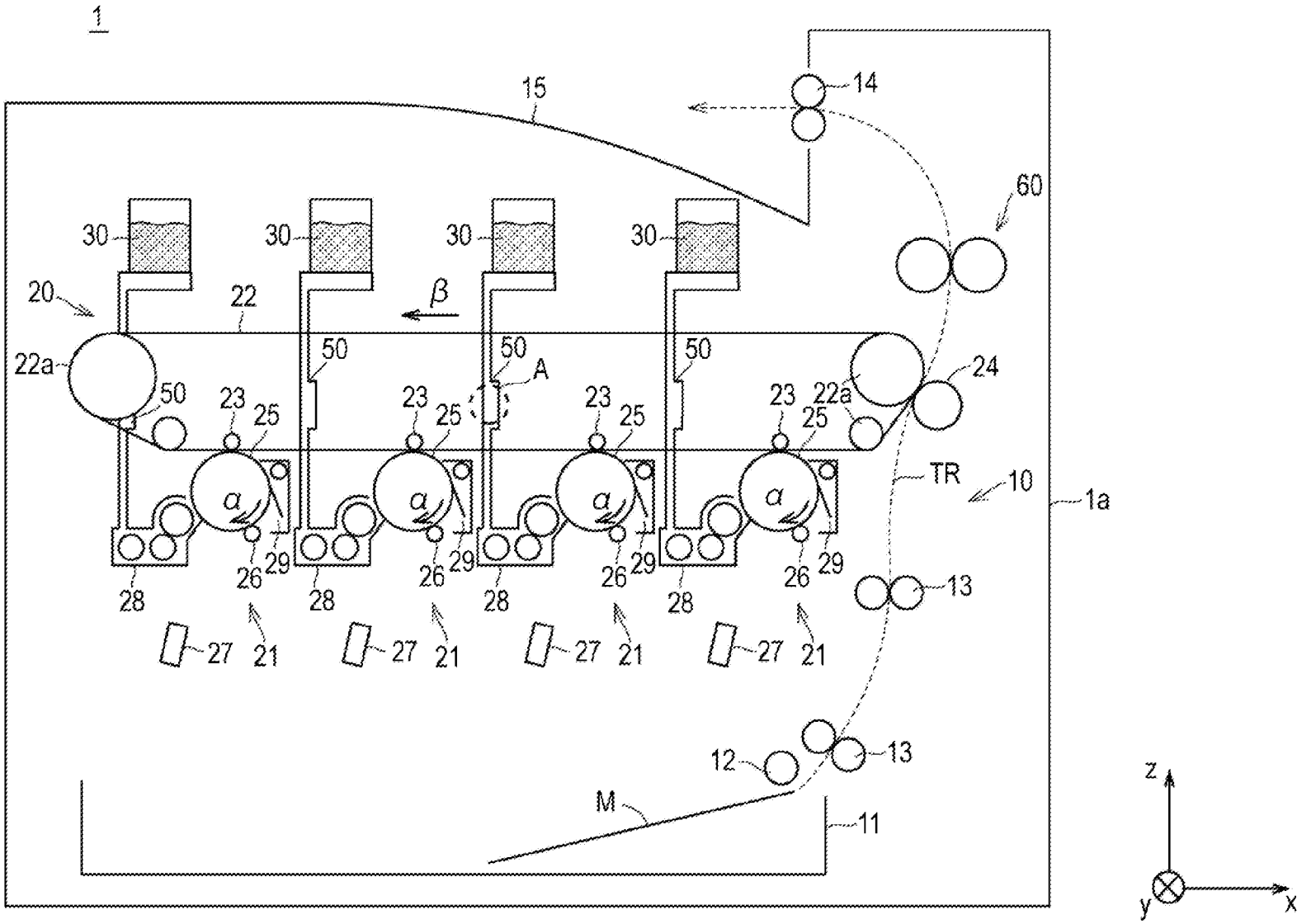
FIG. 18 is a cross-sectional view illustrating a configuration in a variation of the image forming apparatus in one embodiment of the invention.
Figure 19:
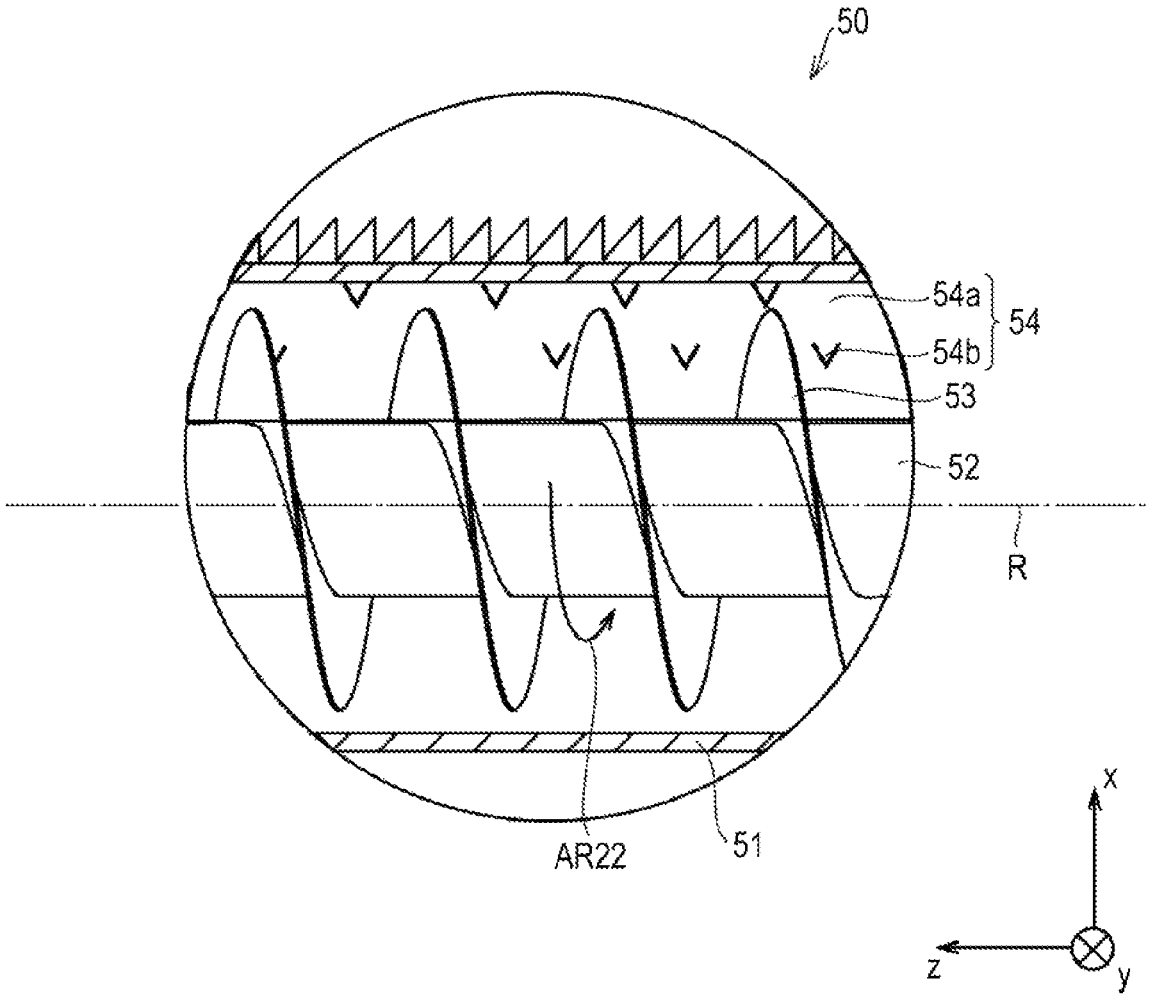
FIG. 19 is an enlarged view of part A in FIG. 18.

FIG. 18 is a cross-sectional view illustrating a configuration in a variation of the image forming apparatus 1 in one embodiment of the invention. FIG. 19 is an enlarged view of part A in FIG. 18.

Referring to FIGS. 18 and 19, the image forming apparatus 1 in the variation is a large-sized MFP. In the image forming apparatus 1 in the variation, the toner image former 20 further includes a hopper 50 (one example of the developer supplying device in the variation) for each color YMCK. In, for example, a large-sized MFP, a hopper for temporarily storing toner is provided to control a supply amount of toner from the toner container 30 to the developing device 28. The hopper 50 transports an appropriate amount of toner from the toner container 30 to the developing device 28. The toner image former 20 forms a toner image on a recording medium with toner supplied by the hopper 50.

The hopper 50 includes a toner reservoir 51 (one example of housings), a screw shaft 52, an impeller 53, and a stirring member 54. The toner reservoir 51 connects the interior of the toner container 30 with that of the developing device 28. In the toner reservoir 51, the screw shaft 52 rotates in a direction indicated by an arrow AR22 around the rotational axis R. The impeller 53 is spirally fixed on the outer peripheral surface of the screw shaft 52 in the toner reservoir 51. The stirring member 54 is fixed on the outer peripheral surface of the screw shaft 52. The stirring member 54 can rotate together with the screw shaft 52 around the rotational axis R against the toner reservoir 51. The stirring member 54 serves to stir toner in the toner reservoir 51 and remove toner deposited on the inner wall surface of the toner reservoir 51.

The stirring member 54 includes a main body 54*a* and a cut part 54*b*. The main body 54*a* is made of a flexible sheet. The main body 54*a* extends in a direction away from the rotational axis R, and is in contact with the inner wall surface of the toner reservoir 51. The cut part 54*b* is formed in the main body 54*a*. The cut part 54*b* projects from the main body 54*a* when the main body 54*a* is bent along with rotation of the stirring member 54.

According to the variation, the projecting cut part 54*b* moves, while being in contact with the surface of toner deposited on the inner wall surface of the toner reservoir 51, along with rotation of the stirring member 54, and shaves the toner deposited on the inner wall surface of the toner reservoir 51. As a result, the developer deposited on the inner wall surface of the toner reservoir 51 can be effectively removed, and toner can be smoothly supplied to the developing device 28.

Note that the configuration, except the foregoing, in each variation illustrated in FIGS. 9A to 19 is the same as that of the image forming apparatus 1 and the toner container 30 in the above embodiment, and consequently the description thereof will not be repeated.

[Other Description]

The above embodiment and variations can be appropriately combined.

Although embodiments of the present invention have been described and illustrated in detail, the disclosed embodiments are made for purposes of illustration and example only and not limitation. The scope of the present invention should be interpreted by terms of the appended claims rather than by the above description, and is intended to include all modifications within the meaning and the range of equivalency of the claims.

What is claimed is:

1. A developer supplying device for supplying a developer to a subject to be supplied, comprising:

a housing; and a stirring member rotatable around a rotational axis in the housing, wherein the stirring member includes:

a main body that includes a flexible sheet, extends away from the rotational axis, and is in contact with an inner wall surface of the housing; and a cut part formed in the main body, wherein the cut part projects from the main body when the main body is bent along with rotation of the stirring member, and wherein the cut part includes a projecting tip that projects from the main body, and when the main body is not bent, the projecting tip has a projecting shape in a direction perpendicular to the rotational axis.

2. The developer supplying device according to claim 1, wherein the cut part includes two or more continuous straight lines, one or more curved lines, or a combination of a straight line and a curved line.

3. The developer supplying device according to claim 1, wherein the stirring member further includes an arm extending parallel with the rotational axis from the main body.

4. The developer supplying device according to claim 3, wherein the arm is bent at least for a part of time during which the stirring member rotates once.

5. The developer supplying device according to claim 1, wherein, when the main body is not bent, the projecting tip has a projecting shape in a direction toward the rotational axis.

6. The developer supplying device according to claim 1, wherein a plurality of cut parts is provided, and each position of the plurality of cut parts along the rotational axis is different.

7. The developer supplying device according to claim 1, wherein the cut part includes:

a first cut part aligned parallel with the rotational axis at a first distance from the rotational axis; and a second cut part aligned parallel with the rotational axis at a second distance, which is larger than the first distance, from the rotational axis, the stirring member further includes an aperture formed around each of the plurality of cut parts in the main body, and a total area of the apertures formed around each of the first cut parts is different from a total area of the apertures formed around each of the second cut parts.

8. The developer supplying device according to claim 7, wherein a total area of the apertures formed around each of the first cut parts is smaller than a total area of the apertures formed around each of the second cut parts.

9. The developer supplying device according to claim 1, wherein the stirring member includes a main body tip that is present in a direction perpendicular to the rotational axis in the main body, and the main body tip includes a first side tilted to the rotational axis.

10. The developer supplying device according to claim 9, wherein the main body tip includes the plurality of first parallel sides tilted to the rotational axis and a second side provided between the plurality of first sides and perpendicular to the rotational axis, and the stirring member further includes another cut part provided adjacent to the second side in the main body.

11. The developer supplying device according to claim 1, wherein a plurality of the stirring members is provided, and positions of the cut parts of the plurality of stirring members along the rotational axis are different.

12. The developer supplying device according to claim 1, wherein the developer supplying device is a toner container removable from an image forming apparatus body.

13. The developer supplying device according to claim 12, further comprising a transporting member that transports the developer to the discharge port by rotation in the second space, wherein the housing includes:

a discharge port that discharges the developer outside the housing; and a partition wall that separates an interior of the housing into a first space in which the stirring member is provided and a second space in which the discharge port is provided.

14. The developer supplying device according to claim 1, wherein the developer supplying device is a hopper that transports the developer from the toner container removable from the image forming apparatus body to a developing device.

15. An image forming apparatus comprising:

the developer supplying device according to claim 1; and an image former that forms a toner image on a recording medium with toner supplied by the developer supplying device.

* * * * *